US010563316B2

(12) United States Patent
Kim et al.

(10) Patent No.: US 10,563,316 B2
(45) Date of Patent: Feb. 18, 2020

(54) FE—P—CR ALLOY THIN PLATE AND METHOD FOR MANUFACTURING SAME

(71) Applicant: POSCO, Pohang-si, Gyeongsangbuk-do (KR)

(72) Inventors: Dongkyun Kim, Pohang-si (KR); Hongseok Yang, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 255 days.

(21) Appl. No.: 15/539,624

(22) PCT Filed: Dec. 2, 2015

(86) PCT No.: PCT/KR2015/013071
§ 371 (c)(1),
(2) Date: Jun. 23, 2017

(87) PCT Pub. No.: WO2016/104981
PCT Pub. Date: Jun. 30, 2016

(65) Prior Publication Data

US 2017/0362729 A1 Dec. 21, 2017

(30) Foreign Application Priority Data

Dec. 24, 2014 (KR) ..... 10-2014-0188842

(51) Int. Cl.
*C25D 1/20* (2006.01)
*C22C 38/40* (2006.01)
*C22C 38/00* (2006.01)

(52) U.S. Cl.
CPC ..... *C25D 1/20* (2013.01); *C22C 38/002* (2013.01); *C22C 38/40* (2013.01); *C22C 2200/02* (2013.01)

(58) Field of Classification Search
None
See application file for complete search history.

(56) References Cited

U.S. PATENT DOCUMENTS 3,486,885 A * 12/1969 Armijo ..... C22C 38/40 420/34
3,917,517 A 11/1975 Jordan et al.
(Continued)

FOREIGN PATENT DOCUMENTS

CA 2675987 A1 8/2008
JP S50-066442 A 6/1975
(Continued)

OTHER PUBLICATIONS

International Search Report and Written Opinion dated Aug. 8, 2016, issued in International Application No. PCT/KR2015/013071. (w/ partial English translation).
(Continued)

*Primary Examiner* — John J Figueroa
(74) *Attorney, Agent, or Firm* — Morgan, Lewis & Bockius LLP

(57) ABSTRACT

The present invention relates to an Fe—P—Cr alloy thin plate and a method for manufacturing the same. An embodiment of the present invention provides an Fe—P—Cr alloy thin plate including, in terms of wt %, P (6.0-13.0%), Cr (0.002-0.1%), and the balance of Fe and other inevitable impurities.

20 Claims, 2 Drawing Sheets

(56) References Cited

U.S. PATENT DOCUMENTS

| | | | | |
|---|---|---|---|---|
| 3,970,445 | A * | 7/1976 | Gale | C22C 1/1042 420/64 |
| 4,011,051 | A * | 3/1977 | Helton | C22C 27/06 172/701.3 |
| 4,101,389 | A | 7/1978 | Uedaira | |
| 6,229,255 | B1 * | 5/2001 | Kim | C21D 8/0205 313/402 |
| 2007/0017601 | A1 * | 1/2007 | Miyata | B22F 3/24 148/105 |
| 2010/0071811 | A1 | 3/2010 | Lacasse et al. | |
| 2015/0211139 | A1 * | 7/2015 | Nagasaki | C22C 38/002 148/102 |
| 2017/0362729 | A1 | 12/2017 | Kim et al. | |

FOREIGN PATENT DOCUMENTS

| | | | |
|---|---|---|---|
| JP | S60-145392 | A | 7/1985 |
| JP | S62-037389 | A | 2/1987 |
| JP | H01-172588 | A | 7/1989 |
| JP | H02-25998 | B2 | 6/1990 |
| JP | 10-226873 | A | 8/1998 |
| JP | 2008-248380 | A | 10/2008 |
| JP | 2010-518252 | A | 5/2010 |
| KR | 2001-0058265 | A | 7/2001 |
| KR | 10-1666797 | B1 | 10/2016 |
| SU | 1601177 | A1 | 10/1990 |
| WO | 2016/104981 | A2 | 6/2016 |

OTHER PUBLICATIONS

B. Li et al., "Electrodeposition and characterization of Fe—Cr—P amorphous alloys from trivalent chromium sulfate electrolyte" Journal of Alloys and Compunds 453 (2008) pp. 93-101.

C.A.C. Souza et al., "Preparation of Fe—Cr—P—Co amorphous alloys by electrodeposition" Surface & Coatings Technology 190 (2005) pp. 75-82.

Office Action issued in Chinese Patent Application No. 201580071238.6 dated Nov. 15, 2018, with English translation.

Office Action issued in corresponding Canadian Patent Application No. 2,972,219 dated Nov. 22, 2019.

* cited by examiner

[Fig. 1]
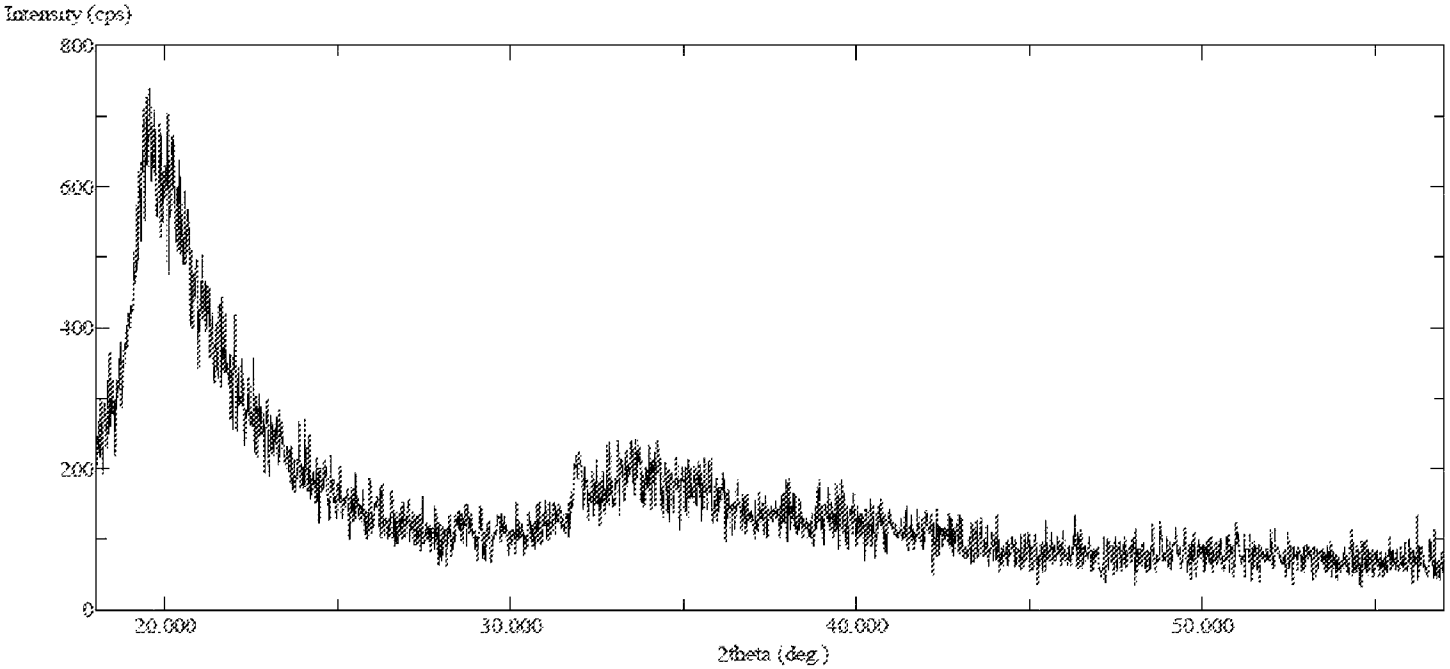

[Fig. 2]
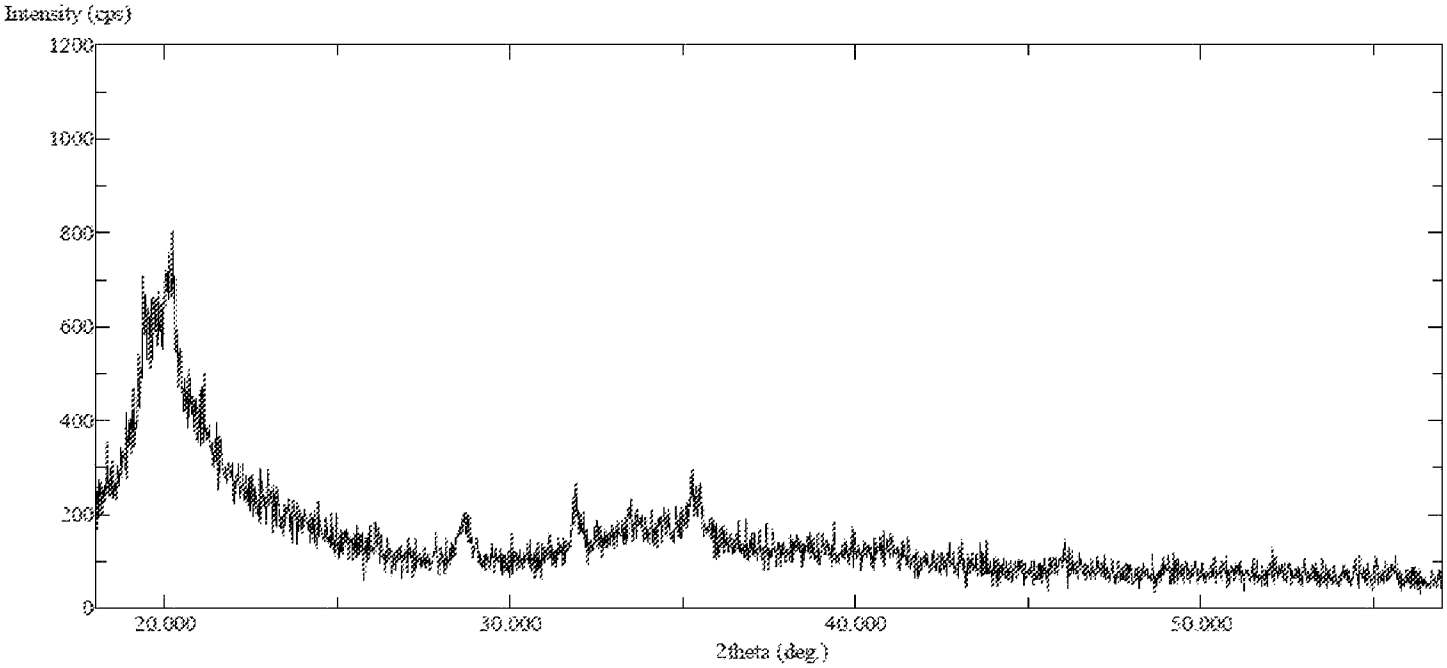

FE—P—CR ALLOY THIN PLATE AND METHOD FOR MANUFACTURING SAME

CROSS-REFERENCE TO RELATED APPLICATIONS

This application is the U.S. National Phase Entry of PCT/KR2015/013071 filed Dec. 2, 2015, which in turn claims priority to and the benefit of Korean Patent Application No. 10-2014-0188842 filed in the Korean Intellectual Property Office on Dec. 24, 2014 the entire contents of each is incorporated herein by reference.

CROSS-REFERENCE TO RELATED APPLICATION

This application claims priority to and the benefit of Korean Patent Application No. 10-2014-0188842 filed in the Korean Intellectual Property Office on Dec. 24, 2014 the entire contents of which are incorporated herein by reference.

BACKGROUND OF THE INVENTION

(a) Field of the Invention

An embodiment of the present invention relates to an Fe—P—Cr alloy thin plate and a method for manufacturing the same.

(b) Description of the Related Art

An embodiment of the present invention relates to an Fe—P—Cr alloy having excellent high frequency magnetic characteristics and a method of manufacturing the same, and in particular, to an Fe—P—Cr alloy including 6.0 to 13.0 wt % of P and 0.002 to 0.1 wt % of Cr which are not processed through rolling but are applied by using electroplating, and having remarkably improved high frequency characteristics compared with a conventional non-oriented one and a thickness of less than or equal to 100 μm, and a method of manufacturing the same.

A steel sheet including silicon is generally referred to as an electrical steel sheet, as it is widely used for electrical equipment. Recently, electric vehicles and high performance electrical equipment using new and renewable energy have been widely used, such that an iron core material having excellent high frequency characteristics is required. In order to improve the high frequency characteristics thereof, a method of adding a resistivity-increasing element such as silicon, decreasing a thickness, or minimizing impurities has been used.

Among these, the most effective method of increasing resistivity is to add an alloy element such as Si, P, and the like. In general, when Si in an amount of greater than or equal to about 3.5 wt % and P in an amount of greater than or equal to 0.1 wt % are added, cold rolling is impossible to apply, and thus there is a limit in improving an iron loss by increasing an amount of the resistivity alloy element.

A method of forming a Si layer by using $SiCl_4$ gas on a rolled sheet in a chemical vapor deposition (CVD) method instead of adding Si during a steel manufacture process and then high-silylating the entire steel sheet through a lengthy diffusion process to improve the high frequency characteristics is disclosed (Japanese Patent Laid-Open Publication Sho 62-227079), but has a problem of using $SiCl_4$ which is a pollutant and increasing a cost due to additions of the chemical vapor deposition (CVD) process and the diffusion process.

In addition, in the method of decreasing a thickness, it may be difficult to realize an ultrathin plate having a thickness of less than or equal to 100 μm due to deterioration of a rolling property when a large amount of the resistivity element is included, and it is difficult to apply to commercial mass production as a manufacturing cost is sharply increased. The method of minimizing impurities from the steel sheet is also complex and expensive.

Accordingly, an embodiment of the present invention provides a method of manufacturing an ultrathin plate having a thickness of less than or equal to 100 μm and excellent magnetic characteristics by adding Si, Mn, and P, thereby producing an excellent resistivity-increasing effect compared to Al in order to efficiently improve high frequency characteristics, and using an electro-forming process instead of a rolling process that is complex and has low productivity while additionally adding Cr.

Regarding Fe—P plating, U.S. Pat. No. 4,101,389 discloses a method of electroplating an Fe—P or Fe—P—Cu thin film on a copper substrate by using iron salt (0.3 to 1.7 M) and phosphate (0.07 to 0.42 M) solutions having pH in a range of 1.0 to 2.2 at 30° C. to 50° C. under a current density of 3 to 20 A/dm$^2$. However, the disclosure describes neither Fe—P—Cr nor manufacture of an independent thin plate other than the plating layer.

T. Osaka and coauthors described an electroplated Fe—P thin film in "Manufacture of Electroplated Fe—P thin film and its soft magnetic characteristics" [The Japanese Magnetics Society, Periodical Vol. 18, Appendix, No. S1, 1994], and therein, most appropriate Fe—P alloy thin films show a minimum coercive force of 0.2 Oe and high-saturated magnetic flux density of 1.4 T under a P content of 27 at %. However, neither the Fe—P—Cr nor the independent thin plate other than the plating layer is described therein.

In addition, regarding an influence of a nano-crystal grain phase on magnetic characteristics, K. Suzuki and coauthors report characteristics that nanocrystal grains included in an amorphous phase improve saturation magnetic flux density in "High saturation magnetization and soft magnetic properties of bcc Fe—Zr—B alloys with ultrafine grain structure" [Mater Trans. JIM. Vol. 3, pp. 743-746, 1990], but not the Fe—P—Cr.

P as an iron alloy element has a greater resistivity-increasing effect than Si, Al, and Mn, but may not be included in an amount of greater than or equal to 0.1 wt % due to deterioration of the rolling property according to segregation when a conventional rolling process is used. However, an electro-forming process does not deteriorate the rolling property and thus may easily provide an ultrathin plate including greater than or equal to 6 wt % of P and having a thickness of less than or equal to 100 μm, and remarkably improves magnetic characteristics by adding 0.002 wt % of Cr.

SUMMARY OF THE INVENTION

An Fe—P—Cr alloy thin plate and a method for manufacturing the same are provided.

An Fe—P—Cr alloy thin plate according to an embodiment of the present invention includes, in terms of wt %, P (6.0-13.0%), Cr (0.002-0.1%), and a balance of Fe and other inevitable impurities.

The Fe—P—Cr alloy thin plate may further include, in terms of wt %, Ni (0.5-5.0%).

The Fe—P—Cr alloy thin plate may have Vickers hardness of less than or equal to 600 HV.

The Fe—P—Cr alloy thin plate may have a saturation magnetic flux density of greater than or equal to 1.5 T.

The Fe—P—Cr alloy thin plate may have a thickness of 1 μm to 100 μm.

The Fe—P—Cr alloy thin plate may have a mixed form of amorphous and crystal grains.

In the Fe—P—Cr alloy thin plate, the crystal grain may have a particle diameter of less than or equal to 100 nm.

In the Fe—P—Cr alloy thin plate, the crystal grain may have a particle diameter of greater than or equal to 0.1 nm and less than or equal to 100 nm.

In the Fe—P—Cr alloy thin plate, the volume fraction of the crystal grain based on an amorphous matrix may be 1% to 10%.

A method for manufacturing an Fe—P—Cr alloy thin plate according to an embodiment of the present invention includes: forming a plating solution including an iron compound, a phosphorus compound, and a chromium compound; applying a current to the formed plating solution; electrodepositing an Fe—P—Cr alloy layer including, in terms of wt %, P (6.0-13.0%), Cr (0.002-0.1%), and the balance of Fe and other inevitable impurities on a cathode plate using the current; and delaminating the Fe—P—Cr alloy layer from the cathode plate to obtain an Fe—P—Cr alloy thin plate.

In the method for manufacturing an Fe—P—Cr alloy thin plate, the Fe—P—Cr alloy thin plate may have a thickness of 1 μm to 100 μm.

In the method for manufacturing the Fe—P—Cr alloy thin plate, the forming of the plating solution including the iron compound, the phosphorus compound, and the chromium compound may include forming a plating solution including an iron compound, a phosphorus compound, a chromium compound, and a nickel compound.

In the forming of the plating solution including the iron compound, the phosphorus compound, the chromium compound, and the nickel compound of the method for manufacturing the Fe—P—Cr alloy thin plate, a concentration of the iron compound in the plating solution may be 0.5 M to 4.0 M.

In the forming of the plating solution including the iron compound, the phosphorus compound, the chromium compound, and the nickel compound of the method for manufacturing the Fe—P—Cr alloy thin plate, the iron compound may include $FeSO_4$, $Fe(SO_3NH_2)_2$, $FeCl_2$, or a combination thereof.

In the forming of the plating solution including the iron compound, the phosphorus compound, the chromium compound, and the nickel compound of the method for manufacturing the Fe—P—Cr alloy thin plate, a concentration of the phosphorus compound in the plating solution may be 0.01 M to 3.0 M.

In the forming of the plating solution including the iron compound, the phosphorus compound, the chromium compound, and the nickel compound of the method for manufacturing the Fe—P—Cr alloy thin plate, the phosphorus compound may include $NaH_2PO_2$, $H_3PO_2$, $H_3PO_3$, or a combination thereof.

In the forming of the plating solution including the iron compound, the phosphorus compound, the chromium compound, and the nickel compound of the method for manufacturing the Fe—P—Cr alloy thin plate, a concentration of the chromium compound in the plating solution may be 0.001 M to 2.0 M.

In the forming of the plating solution including the iron compound, the phosphorus compound, the chromium compound, and the nickel compound of the method for manufacturing the Fe—P—Cr alloy thin plate, the chromium compound may include $CrCl_3$, $Cr_2(SO_4)_3$, $CrO_3$, or a combination thereof.

In the forming of the plating solution including the iron compound, the phosphorus compound, the chromium compound, and the nickel compound of the method for manufacturing the Fe—P—Cr alloy thin plate, a concentration of the nickel compound in the plating solution may be 0.1 M to 3.0 M.

In the forming of the plating solution including the iron compound, the phosphorus compound, the chromium compound, and the nickel compound of the method for manufacturing the Fe—P—Cr alloy thin plate, the nickel compound may be $NiSO_4$, $NiCl_2$, or a combination thereof.

The forming of the plating solution including the iron compound, the phosphorus compound, the chromium compound, and the nickel compound of the method for manufacturing the Fe—P—Cr alloy thin plate may include forming a plating solution including the iron compound, the phosphorus compound, the chromium compound, the nickel compound, and an additive.

A concentration of the additive in the plating solution of the method for manufacturing the Fe—P—Cr alloy thin plate may be 0.001 M to 0.1 M.

The additive of the method for manufacturing the Fe—P—Cr alloy thin plate may include glycolic acid, saccharin, beta-alanine, DL-alanine, succinic acid, or a combination thereof.

In the forming of the plating solution including the iron compound, the phosphorus compound, and the chromium compound of the method for manufacturing the Fe—P—Cr alloy thin plate, pH of the plating solution may be 1 to 4.

In the forming of the plating solution including the iron compound, the phosphorus compound, and the chromium compound of the method for manufacturing the Fe—P—Cr alloy thin plate, a temperature of the plating solution may be 30° C. to 100° C.

In the applying of a current to the formed plating solution of the method for manufacturing the Fe—P—Cr alloy thin plate, the current may be a DC current or a pulse current.

In the applying of a current to the formed plating solution of the method for manufacturing the Fe—P—Cr alloy thin plate, a current density may be 1 $A/dm^2$ to 100 $A/dm^2$.

The electrodepositing of the Fe—P—Cr alloy layer including, in terms of wt %, P (6.0-13.0%), Cr (0.002-0.1%), and the balance of Fe and other inevitable impurities on a cathode plate using the current of the method for manufacturing the Fe—P—Cr alloy thin plate may include electrodepositing an Fe—P—Cr—Ni alloy layer including, in terms of wt %, P (6.0-13.0%), Cr (0.002-0.1%), Ni (0.5-5.0%), and the balance of Fe and other inevitable impurities on a cathode plate using the current.

In the delaminating of the Fe—P—Cr alloy layer from the cathode plate to obtain an Fe—P—Cr alloy thin plate of the method for manufacturing the Fe—P—Cr alloy thin plate, the cathode plate may include a material of stainless steel, titanium, or a combination thereof.

An embodiment of the present invention relates to an Fe—P—Cr alloy thin plate that includes P (6.0-13.0%), Cr (0.002-0.1%), and the balance of Fe and other inevitable impurities in terms of wt %, and further includes Ni (0.5-5.0%), and may have a saturation magnetic flux density of greater than or equal to 1.5 T and a much lower high frequency iron loss due to an effect of a mixed phase of amorphous and crystal grains according to the addition of Cr compared with a conventional Fe—P alloy thin plate. In addition, an Fe—P—Cr—Ni alloy may lower hardness due to addition of Ni such that it may have very easy workability. Furthermore, an ultrathin plate having a thickness of less than or equal to 100 μm and excellent magnetic characteristics may be provided by adding P having excellent effect of further increasing resistivity than Si, Mn, and Al, and using an electro-forming process.

Accordingly, the Fe—P—Cr alloy for an ultrathin plate having a high frequency and low iron loss may be used as a soft magnetic material for a motor core, an inverter, a converter, and the like. In addition, the Fe—P—Cr alloy ultrathin plate having excellent high frequency characteristics as well as using a simple and inexpensive process compared with 6.5% Si steel which is the most expensive non-oriented electrical steel sheet, may be easily mass produced.

BRIEF DESCRIPTION OF THE DRAWINGS

FIG. 1 shows an XRD analysis result of an Fe-11 wt % P material.

FIG. 2 shows an XRD analysis result of an Fe-11 wt % P-0.0023 wt % Cr material according to an embodiment of the present invention.

DETAILED DESCRIPTION

Advantages and features of the present invention and methods to achieve them will become apparent from exemplary embodiments described below in detail with reference to the accompanying drawings. However, as those skilled in the art would realize, the described embodiments may be modified in various different ways, all without departing from the spirit or scope of the present invention, and on the contrary, exemplary embodiments introduced herein are provided to make disclosed contents thorough and complete and sufficiently transfer the spirit of the present invention to those skilled in the art. Therefore, the present invention will be defined only by the scope of the appended claims. Like reference numerals refer to like elements throughout the specification.

In some exemplary embodiments, detailed description of well-known technologies will be omitted to prevent the disclosure of the present invention from being interpreted ambiguously. Unless otherwise defined, all terms (including technical and scientific terms) used herein have the same meaning as commonly understood by a person skilled in the art. Through the specification, unless explicitly described to the contrary, the word "comprise" and variations such as "comprises" or "comprising" will be understood to imply the inclusion of stated elements but not the exclusion of any other elements. Further, the singular forms are intended to include the plural forms as well, unless the context clearly indicates otherwise.

An Fe—P—Cr alloy thin plate according to an embodiment of the present invention is an Fe—P—Cr alloy thin plate including, in terms of wt %, P (6.0-13.0%), Cr (0.002-0.1%), and the balance of Fe and other inevitable impurities.

The thin plate may be an Fe—P—Cr alloy thin plate that further includes Ni at 0.5-5.0% in terms of wt %.

Hereinafter, reason for limiting components in an embodiment of the present invention are illustrated.

P plays a role of increasing resistivity and thus decreasing an iron loss.

As more P is added, an effect of increasing resistivity is simultaneously obtained. However, when the P is included in an amount of less than 6 wt % during manufacture in an electro-forming method, an amorphous phase is not formed, and thus an effect of additionally increasing resistivity may not be expected. In addition, when P is included in an amount of greater than 13 wt %, the obtained alloy may not be commercially available due to deteriorated workability.

Cr plays a role of reducing high frequency iron loss due to formation of a crystal grain.

When Cr is included in an amount of less than 0.002 wt %, characteristics of forming crystal grains are deteriorated, and thus an amorphous-crystal grain composite is not formed. Accordingly, the high frequency iron loss may be difficult to reduce, but when Cr is included in an amount of greater than 0.1 wt %, workability may be deteriorated, and thus Cr is preferably included in an amount of less than or equal to 0.1 wt %.

In addition, when Cr is included in an amount of greater than or equal to 0.002 wt %, saturation magnetic flux density may be improved through formation of amorphous-crystal grain composites up to greater than or equal to 1.5 T, which is high enough to be used for a driving motor and the like.

Accordingly, the Cr-containing thin plate is a mixed form of amorphous and crystal grain, and herein, the crystal grain has a volume fraction of 1% to 10% relative to the amorphous matrix. When the range is satisfied, the saturation magnetic flux density may be improved.

In addition, the crystal grain in the thin plate may have a particle diameter of greater than or equal to 0.1 nm and less than or equal to 100 nm.

In this way, when nanocrystal grains having a size within the range are present inside the amorphous matrix, the saturation magnetic flux density may be improved compared with an amorphous single phase. Accordingly, when the crystal grain has a size of greater than or equal to 100 nm, an effect of deteriorating iron loss and increasing the saturation magnetic flux density may be reduced.

The particle diameter indicates a diameter or size of a particle, and is defined as a diameter in an embodiment of the present invention and hereinafter.

In addition, a particle diameter of a crystal grain in the present specification is calculated by putting a diffraction angle and intensity of a diffraction beam from data obtained by using an XRD analysis into the Scherrer equation.

Ni plays a role of weakening hardness and improving workability.

When Ni is included in an amount of greater than or equal to 0.5 wt % and less than or equal to 5.0 wt %, hardness may be weakened, and thus workability may be improved.

However, when Ni is included in an amount of greater than 5.0 wt %, the saturation magnetic flux density is decreased to less than 1.5 T, and the obtained alloy may not be used as a material for a driving motor and the like. Accordingly, in order to secure industrial usage of the obtained alloy, Ni should be used within the range, and the saturation magnetic flux density should be greater than or equal to 1.5 T. The higher the saturation magnetic flux density is, the better, but the saturation magnetic flux density should specifically be in a range of greater than or equal to 1.5 but less than or equal to 2.0 T in the present specification.

Furthermore, the Ni-containing thin plate may have Vickers hardness of less than or equal to 600 HV. When Vickers hardness is within the range, workability of a thin plate may be improved. Specifically, Vickers hardness may be in a range of greater than or equal to 300 HV and less than or equal to 600 HV.

In addition, the Fe—P—Cr alloy thin plate may have a thickness of 1 μm to 100 μm.

The range is a general thickness range of a thin plate, but the present invention is not limited thereto.

Hereinafter, a method for manufacturing the Fe—P—Cr alloy thin plate according to an embodiment of the present invention is illustrated.

The method for manufacturing the Fe—P—Cr alloy thin plate includes preparing a plating solution including an iron compound, a phosphorus compound, and a chromium compound.

The forming of the plating solution including the iron compound, the phosphorus compound, and the chromium compound may include forming a plating solution by further including a nickel compound.

The iron compound may be included in a concentration range of 0.5 M to 4.0 M in the plating solution. When this range is satisfied, an Fe—P—Cr plating layer may be properly formed.

For specific examples, the iron compound may be $FeSO_4$, $Fe(SO_3NH_2)_2$, $FeCl_2$, or a combination thereof. However, the present invention is not limited thereto.

The phosphorus compound may be included in a concentration range of 0.01 M to 3.0 M in the plating solution. When this range is satisfied, the Fe—P—Cr plating layer may be properly formed.

For specific examples, the phosphorus compound may be $NaH_2PO_2$, $H_3PO_2$, $H_3PO_3$, or a combination thereof. However, the present invention is not limited thereto.

The chromium compound may be included in a concentration range of 0.001 M to 2.0 M in the plating solution. When this range is satisfied, the Fe—P—Cr plating layer may be properly formed.

For specific examples, the chromium compound may be $CrCl_3$, $Cr_2(SO_4)_3$, $CrO_3$, or a combination thereof. However, the present invention is not limited thereto.

The nickel compound in the plating solution may be included in a concentration range of 0.1 M to 3.0 M. When this range is satisfied, an Fe—P—Cr plated layer may be properly formed. For specific examples, the nickel compound may be $NiSO_4$, $NiCl_2$, or a combination thereof. However, the present invention is not limited thereto.

In addition, an additive may be further added to the plating solution.

The additive may be used in a concentration range of 0.001 M to 0.1 M. When the range is not satisfied, an Fe—P—Cr plated layer may not be properly formed. In addition, when the additive in added in an amount of greater than 0.1 M, an effect of forming a plating layer may be excessive, and further addition is ineffectual, and thus is not economical.

More specifically, glycolic acid, saccharin, beta-alanine, DL-alanine, succinic acid, or a combination thereof may be included.

The plating solution may have pH ranging from 1 to 4 and a temperature ranging from 30° C. to 100° C.

The pH of the plating solution may be adjusted within a range of 1 to 4 by adding at least one acid and/or at least one base.

Accordingly, when the pH of the plating solution is satisfied, the Fe—P—Cr plated layer may be properly formed.

In addition, when a temperature in a plating bath is in a range of 30° C. to 100° C., the Fe—P—Cr plated layer may be properly formed.

Subsequently, a current is applied to the prepared plating solution.

The current may be a DC current or a pulse current, and may have current density in a range of 1 $A/dm^2$ to 100 $A/dm^2$. When the current density is within the range, the Fe—P—Cr plated layer may be properly formed.

Within the range, the current density may be changed to adjust a P composition.

In addition, the current may be used to electroplate an Fe—P—Cr alloy layer including P (6.0-13.0%), Cr (0.002-0.1%), and the balance of Fe and other inevitable impurities in terms of wt % on a cathode plate.

The current may also be used to electroplate an Fe—P—Cr—Ni alloy layer including P (6.0-13.0%), Cr (0.002-0.1%), Ni (0.5-5.0%), and the balance of Fe and other inevitable impurities in terms of wt % on a cathode plate.

Lastly, the Fe—P—Cr alloy layer is delaminated from the cathode plate to obtain an Fe—P—Cr alloy thin plate.

The cathode plate may include stainless steel, titanium, or a combination thereof. However, the cathode plate is not limited thereto, and may include all materials having acid resistance and an oxide film.

The Fe—P—Cr alloy thin plate may have a thickness of 1 μm to 100 μm.

The range is a general range of a thin plate, and the present invention is not limited thereto.

Hereinafter, examples are described in detail. However, the following examples show exemplary embodiments of the present invention, but do not limit it.

Example 1

A plating solution including an iron compound, a phosphorus compound, and a chromium compound according to an embodiment of the present invention was prepared, and a current was applied to the plating solution.

The current was used to electroplate an Fe—P—Cr alloy layer including, in terms of wt %, P (6.0-13.0%), Cr (0.002-0.1%), and the balance of Fe and other inevitable impurities on a cathode plate.

Subsequently, the Fe—P—Cr alloy layer was peeled off from the cathode plate to obtain an Fe—P—Cr thin plate.

The contents of P and Cr were changed within the above ranges to perform an experiment, and its results are shown in Table 1.

TABLE 1

| | P content [wt %] | Cr content [wt %] | Microstructure | Average crystal grain size (nm) | Iron loss W10/400 [W/kg] | Workability |
|---|---|---|---|---|---|---|
| Comparative material 1 | 5.78 | 0 | crystalline | 15.0 | 11.3 | — |
| Comparative material 2 | 6.15 | 0 | amorphous | 17.1 | 8.6 | — |
| Inventive material 1 | 6.1 | 0.0022 | mixed form of amorphous-nanocrystal grain | 8.2 | 5.1 | Excellent |

TABLE 1-continued

| | P content [wt %] | Cr content [wt %] | Microstructure | Average crystal grain size (nm) | Iron loss W10/400 [W/kg] | Workability |
|---|---|---|---|---|---|---|
| Comparative material 3 | 13.3 | 0.0025 | mixed form of amorphous-nanocrystal grain | 15.0 | 5.02 | Inferior |
| Comparative material 4 | 12.5 | 0.12 | mixed form of amorphous-nanocrystal grain | 10.1 | 5 | Inferior |
| Comparative material 5 | 6.2 | 0.13 | mixed form of amorphous-nanocrystal grain | 8.2 | 5.15 | Inferior |
| Inventive material 2 | 6.22 | 0.097 | mixed form of amorphous-nanocrystal grain | 7.4 | 5.09 | Excellent |
| Inventive material 3 | 12.6 | 0.095 | amorphous- mixed form of amorphous-nanocrystal grain | 9.5 | 4.9 | Excellent |

As shown in Table 1, an Fe—P—Cr alloy manufactured in an electrofoming method according to an exemplary embodiment of the present invention, unlike an Fe—P alloy, showed a mixed phase of amorphous and crystal grains. The reason is that the mixed phase of amorphous and crystal grain due to addition of Cr lowered an iron loss compared with a single amorphous phase.

In addition, as described above, a nano-sized crystal grain was present in a fraction of 1-10% based on the entire volume of the mixed phase of amorphous-nanocrystal grains of the inventive material.

In addition, the workability in Table 1 was evaluated by judging whether an alloy was cracked or not during a punching process, and as a result, the Fe—P—Cr alloy manufactured in the electroforming method turned out to be excellent compared with an alloy manufactured in other methods.

Example 2

A plating solution including an iron compound, a phosphorus compound, and a chromium compound according to an embodiment of the present invention was prepared, and a current was applied to the plating solution.

The current was used to electrodeplate an Fe—P—Cr—Ni alloy layer including P (6.0-13.0%), Cr (0.002-0.1%), Ni (0.5-5.0%), and the balance of Fe and other inevitable impurities in terms of wt % on a cathode plate.

Accordingly, the Fe—P—Cr—Ni alloy layer was peeled off from the cathode plate to obtain an Fe—P—Cr—Ni thin plate.

The contents of P, Cr, and Ni were changed within the above range to perform an experiment, and the experiment results are shown in Table 2.

TABLE 2

| | P content [wt %] | Cr content [wt %] | Ni content [wt %] | Vickers hardness [HV] | Saturation magnetic flux density [T] |
|---|---|---|---|---|---|
| Inventive material A1 | 6.1 | 0.0022 | 0 | 605 | 1.65 |
| Inventive material A2 | 12.5 | 0.095 | 0 | 613 | 1.62 |
| Inventive material A3 | 6.12 | 0.0025 | 0.53 | 537 | 1.65 |

TABLE 2-continued

| | P content [wt %] | Cr content [wt %] | Ni content [wt %] | Vickers hardness [HV] | Saturation magnetic flux density [T] |
|---|---|---|---|---|---|
| Inventive material A4 | 12.4 | 0.097 | 0.52 | 545 | 1.62 |
| Comparative material A1 | 6.15 | 0.0023 | 10.2 | 533 | 1.46 |
| Comparative material A2 | 12.6 | 0.097 | 10.1 | 541 | 1.43 |
| Inventive material A5 | 6.13 | 0.0025 | 9.8 | 533 | 1.55 |
| Inventive material A6 | 12.7 | 0.096 | 9.8 | 541 | 1.52 |

Table 2 shows hardness and saturation magnetic flux density results depending on components of an Fe—P—Ni—Cr material manufactured through electro-formation.

As shown in Table 2, when Ni was added, hardness was deteriorated, but when the Ni was included in an amount of greater than 5.0 wt %, saturation magnetic flux density was less than 1.5 T.

Although the exemplary embodiments of the present invention have been described with reference to the accompanying drawings, it will be apparent to those skilled in the art that various modifications and changes may be made thereto without departing from the technical spirit or essential features of the invention.

Therefore, the aforementioned embodiments should be understood to be exemplary but not limiting the present invention in any way. The scope of the present invention is defined by the appended claims rather than the detailed description, and all changes or modifications derived from the meaning and scope of the appended claims and their equivalents should be interpreted as falling within the scope of the present invention.

What is claimed is:

1. An Fe—P—Cr alloy thin plate comprising, in terms of wt %, P (6.0-13.0%), Cr (0.002-0.1%), and the balance of Fe and other inevitable impurities.

2. The Fe—P—Cr alloy thin plate of claim 1, wherein the Fe—P—Cr alloy thin plate further includes Ni (0.5-5.0%) in terms of wt %.

3. The Fe—P—Cr alloy thin plate of claim 2, wherein the thin plate has Vickers hardness of less than or equal to 600 HV.

4. The Fe—P—Cr alloy thin plate of claim 3, wherein the thin plate has a saturation magnetic flux density of greater than or equal to 1.5 T.

5. The Fe—P—Cr alloy thin plate of claim 4, wherein the thin plate has a thickness of 1 μm to 100 μm.

6. The Fe—P—Cr alloy thin plate of claim 5, wherein the Fe—P—Cr alloy thin plate has a mixed form of amorphous and crystal grains.

7. The Fe—P—Cr alloy thin plate of claim 6, wherein the crystal grain has a particle diameter of greater than or equal to 0.1 nm and less than or equal to 100 nm.

8. The Fe—P—Cr alloy thin plate of claim 7, wherein a volume fraction of the crystal grain based on an amorphous matrix is 1% to 10%.

9. A method of manufacturing an Fe—P—Cr alloy thin plate, comprising:

forming a plating solution including an iron compound, a phosphorus compound, and a chromium compound;

applying a current to the formed plating solution;

electrodepositing an Fe—P—Cr alloy layer including, in terms of wt %, P (6.0-13.0%), Cr (0.002-0.1%), and the balance of Fe and other inevitable impurities on a cathode plate using the current; and delaminating the Fe—P—Cr alloy layer from the cathode plate to obtain an Fe—P—Cr alloy thin plate.

10. The method of manufacturing an Fe—P—Cr alloy thin plate of claim 9, wherein the Fe—P—Cr alloy thin plate has a thickness of 1 μm to 100 μm.

11. The method of manufacturing an Fe—P—Cr alloy thin plate of claim 9, wherein the forming of the plating solution including the iron compound, the phosphorus compound, and the chromium compound includes forming a plating solution including an iron compound, a phosphorus compound, a chromium compound, and a nickel compound.

12. The method of manufacturing an Fe—P—Cr alloy thin plate of claim 11, wherein in the forming of the plating solution including the iron compound, the phosphorus compound, the chromium compound, and the nickel compound, a concentration of the iron compound in the plating solution is 0.5 M to 4.0 M, and the iron compound includes $FeSO_4$, $Fe(SO_3NH_2)_2$, $FeCl_2$, or a combination thereof.

13. The method of manufacturing an Fe—P—Cr alloy thin plate of claim 12, wherein in the forming of the plating solution including the iron compound, the phosphorus compound, the chromium compound, and the nickel compound, a concentration of the phosphorus compound in the plating solution is 0.01 M to 3.0 M, and the phosphorus compound includes $NaH_2PO_2$, $H_3PO_2$, $H_3PO_3$, or a combination thereof.

14. The method of manufacturing an Fe—P—Cr alloy thin plate of claim 13, wherein in the forming of the plating solution including the iron compound, the phosphorus compound, the chromium compound, and the nickel compound, a concentration of the chromium compound in the plating solution is 0.001 M to 2.0 M, and the chromium compound includes $CrCl_3$, $Cr_2(SO_4)_3$, $CrO_3$, or a combination thereof.

15. The method of manufacturing an Fe—P—Cr alloy thin plate of claim 14, wherein in the forming of the plating solution including the iron compound, the phosphorus compound, the chromium compound, and the nickel compound, a concentration of the nickel compound in the plating solution is 0.1 M to 3.0 M, and the nickel compound includes $NiSO_4$, $NiCl_2$, or a combination thereof.

16. The method of manufacturing an Fe—P—Cr alloy thin plate of claim 11, wherein the forming of the plating solution including the iron compound, the phosphorus compound, the chromium compound, and the nickel compound includes forming a plating solution including the iron compound, the phosphorus compound, the chromium compound, the nickel compound, and an additive, wherein a concentration of the additive in the plating solution is 0.001 M to 0.1 M.

17. The method of manufacturing an Fe—P—Cr alloy thin plate of claim 9, wherein in the forming of the plating solution including the iron compound, the phosphorus compound, and the chromium compound, pH of the plating solution is 1 to 4.

18. The method of manufacturing an Fe—P—Cr alloy thin plate of claim 9, wherein in the forming of the plating solution including the iron compound, the phosphorus compound, and the chromium compound, a temperature of the plating solution is 30° C. to 100° C.

19. The method of manufacturing an Fe—P—Cr alloy thin plate of claim 9, wherein in the applying of a current to the formed plating solution, a current density is 1 $A/dm^2$ to 100 $A/dm^2$.

20. The method of manufacturing an Fe—P—Cr alloy thin plate of claim 9, wherein the electrodepositing of the Fe—P—Cr alloy layer including, in terms of wt %, P (6.0-13.0%), Cr (0.002-0.1%), and the balance of Fe and other inevitable impurities on a cathode plate using the current includes electrodepositing an Fe—P—Cr—Ni alloy layer including, in terms of wt %, P (6.0-13.0%), Cr (0.002-0.1%), Ni (0.5-5.0%), and the balance of Fe and other inevitable impurities on a cathode plate using the current.

* * * * *